US012345023B2

(12) United States Patent
Ueta et al.

(10) Patent No.: US 12,345,023 B2
(45) Date of Patent: Jul. 1, 2025

(54) WORK MACHINE

(71) Applicant: KOBELCO CONSTRUCTION MACHINERY CO., LTD., Hiroshima (JP)

(72) Inventors: Toshiro Ueta, Hiroshima (JP); Michio Hirayama, Hiroshima (JP); Tsutomu Fujisaki, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 692 days.

(21) Appl. No.: 17/731,463

(22) Filed: Apr. 28, 2022

(65) Prior Publication Data

US 2022/0364336 A1 Nov. 17, 2022

(30) Foreign Application Priority Data

May 17, 2021 (JP) ..... 2021-083293

(51) Int. Cl.
*E02F 9/26* (2006.01)
*E02F 3/43* (2006.01)

(52) U.S. Cl.
CPC ..... *E02F 9/265* (2013.01); *E02F 3/437* (2013.01)

(58) Field of Classification Search
CPC ... E02F 3/32; E02F 3/435; E02F 3/437; E02F 9/24; E02F 9/264; E02F 9/265;
(Continued)

(56) References Cited

U.S. PATENT DOCUMENTS

2014/0107897 A1 4/2014 Zhu et al.
2021/0054595 A1 2/2021 Sano
(Continued)

FOREIGN PATENT DOCUMENTS

JP 11-230821 A 8/1999
JP 2007-178362 A 7/2007
(Continued)

OTHER PUBLICATIONS

Office Action issued Apr. 11, 2023, in corresponding Japanese Patent Application No. 2021-083293 (with English Translation), 6 pages.

(Continued)

*Primary Examiner* — Adam J Behrens
*Assistant Examiner* — Robert E Pezzuto
(74) *Attorney, Agent, or Firm* — Oblon, McClelland, Maier & Neustadt, L.L.P.

(57) ABSTRACT

A property calculation section of the controller calculates a horizontal distance between a boom proximal end portion and an arm distal end portion based on a detection signal input from an attitude detector, calculates a weight of the distal end attachment based on the horizontal distance and a detection signal input from a holding pressure detector in a state where a distal end attachment is disposed at a pressure release position, and calculates a gravity center position of the distal end attachment based on the weight of the distal end attachment, a detection signal input from the holding pressure detector, and a detection signal input from the attitude detector in a state where the distal end attachment is disposed at a displacement position that is a position different from the pressure release position.

4 Claims, 7 Drawing Sheets

(58) Field of Classification Search
CPC ..... E02F 9/2029; E02F 9/2271; E02F 9/2214; E02F 9/2285; E02F 9/2292; E02F 9/2228
See application file for complete search history.

(56) References Cited

U.S. PATENT DOCUMENTS

| | | | | |
|---|---|---|---|---|
| 2021/0301492 | A1* | 9/2021 | Nogi | E02F 9/2228 |
| 2022/0389681 | A1* | 12/2022 | Ueta | E02F 9/24 |
| 2023/0257961 | A1* | 8/2023 | Hiranuma | E02F 9/26 37/347 |

FOREIGN PATENT DOCUMENTS

| | | | |
|---|---|---|---|
| JP | 2012-007694 | A | 1/2012 |
| JP | 2021-031904 | A | 3/2021 |

OTHER PUBLICATIONS

Extended European Search Report issued Oct. 21, 2022, in corresponding European Patent Application No. 22171540.2, 5 pages.

* cited by examiner $L_{3g} = L \cdot \cos(\text{Bugdeg})$ $H_{3g} = L \cdot \sin(\text{Bugdeg})$

WORK MACHINE

TECHNICAL FIELD

The present disclosure relates to a work machine such as a hydraulic excavator.

BACKGROUND ART

Conventionally, for example, a work machine such as a hydraulic excavator is known. The hydraulic excavator is provided with a work device including a boom, an arm, and a distal end attachment, and performs loading work for loading a work object such as earth and sand, scraps, and the like onto a destination such as a dump truck at a work site. As such a hydraulic excavator, one having a so-called payload function is also known. The payload function is a function of measuring a load of an object such as earth and sand, or scraps held by a distal end attachment such as a bucket or a lifting magnet. By using this payload function at the time of loading operation onto a dump truck by a hydraulic excavator, it is possible to calculate an amount of an object (an amount of earth and sand, an amount of scraps) to be loaded onto the dump truck. In the calculation of a load of the object using the payload function, data of a weight and a gravity center position of the distal end attachment is used.

Japanese Patent Application Laid-Open No. 2007-178362 discloses an attachment data compensation method aimed at, even when an attachment having unknown gravity center position and weight data is attached to a working arm, readily compensating the data. In this compensation method, a pressure of a bucket cylinder is released, and the center of gravity of a magnet is positioned immediately below an attachment mounting pin. Since an error between a moment by a holding force calculated from a pressure of a boom cylinder and a moment of the working arm excluding the magnet is equal to a moment by a magnet weight, the magnet weight is calculated. While calculating a magnet gravity center angle in a magnet coordinate system, an angle of the magnet to the ground is set, a horizontal distance from the attachment mounting pin to the center of gravity of the magnet is calculated by the magnet weight and a moment around the attachment mounting pin by the holding force calculated from the pressure of the bucket cylinder.

In the work machine disclosed in Japanese Patent Application Laid-Open No. 2007-178362, in order to calculate the magnet weight and the center of gravity of the magnet, both a pressure sensor that detects a pressure of the boom cylinder and a pressure sensor that detects a pressure of the bucket cylinder are required. Therefore, there is a problem of causing the work machine to have a complicated configuration, which leads to an increase in cost. In addition, when a pressure sensor is disposed in the vicinity of a distal end attachment such as a bucket or a lifting magnet, the pressure sensor is liable to be damaged.

SUMMARY OF INVENTION

An object of the present disclosure is to provide a work machine capable of specifying a weight and a gravity center position of a distal end attachment with a simple configuration.

Provided is a work machine including: a machine body; a boom having a boom proximal end portion which is a proximal end portion supported by the machine body so as to be raised and lowered; an arm having an arm proximal end portion rotatably supported by a distal end portion of the boom and an arm distal end portion which is a distal end portion on an opposite side of the arm proximal end portion; a distal end attachment having a distal end attachment proximal end portion which is a proximal end portion rotatably supported by the arm distal end portion; a boom cylinder which is a hydraulic cylinder that operates so as to raise and lower the boom with respect to the machine body; an arm cylinder which is a hydraulic cylinder that operates so as to rotate the arm with respect to the boom; a distal end cylinder which is a hydraulic cylinder that operates so as to rotate the distal end attachment with respect to the arm; an attitude detector that detects attitudes of the boom, the arm, and the distal end attachment; a holding pressure detector that detects a holding pressure of the boom cylinder; and a controller including a property calculation section, in which the property calculation section includes: calculating a horizontal distance between the boom proximal end portion and the arm distal end portion based on a detection signal input from the attitude detector; calculating a weight of the distal end attachment based on the horizontal distance and a detection signal input from the holding pressure detector in a state where the distal end attachment is disposed at a pressure release position which is a position when a pressure of the distal end cylinder is released; and calculating a gravity center position of the distal end attachment based on the weight of the distal end attachment, a detection signal input from the holding pressure detector, and a detection signal input from the attitude detector in a state where the distal end attachment is disposed at a displacement position which is a position different from the pressure release position.

DESCRIPTION OF EMBODIMENTS

A preferred embodiment of the present disclosure will be described with reference to the drawings.

Figure 1:
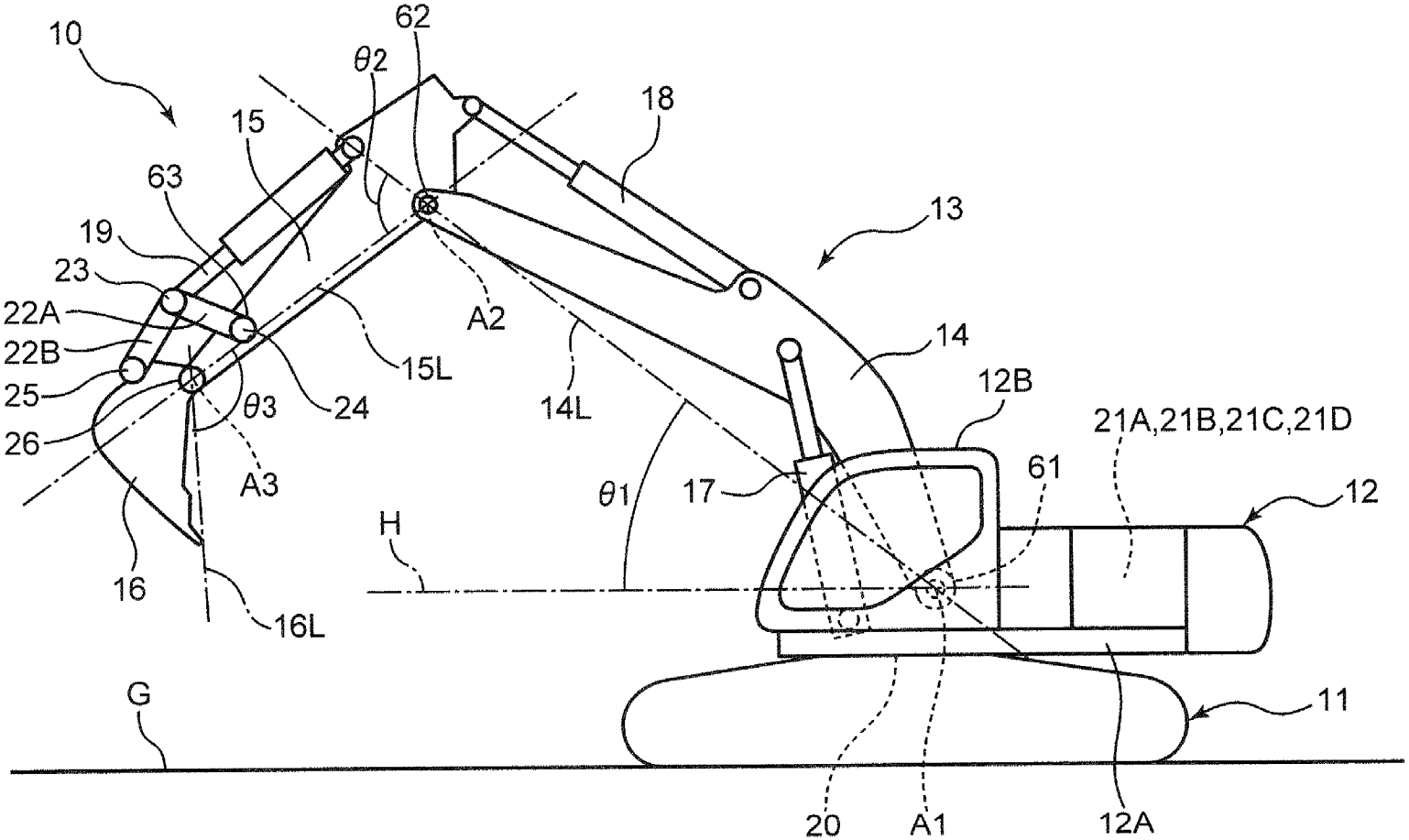
FIG. 1 is a side view illustrating a hydraulic excavator which is an example of a work machine according to an embodiment of the present disclosure.
Figure 2:
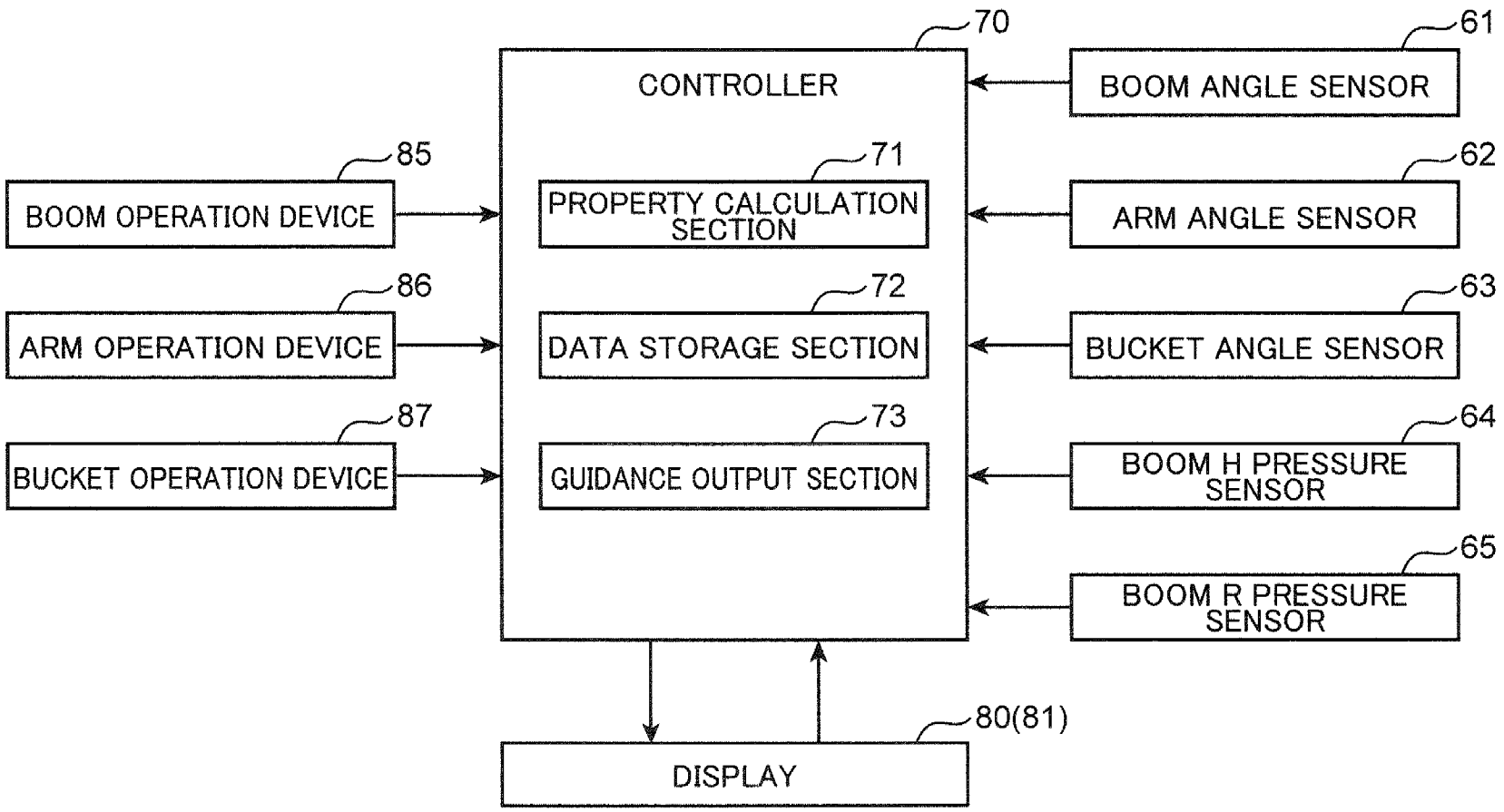
FIG. 2 is a block diagram illustrating a functional configuration of a controller in the hydraulic excavator.

FIG. 1 illustrates a hydraulic excavator which is an example of a work machine according to an embodiment of the present disclosure. FIG. 2 is a diagram illustrating a configuration of a controller mounted on the hydraulic excavator and a circuit controlled by the controller.

As illustrated in FIG. 1 and FIG. 2, a hydraulic excavator 10 includes a lower travelling body 11, an upper slewing body 12 slewably mounted on the lower travelling body 11, a work device 13 mounted on the upper slewing body 12, a plurality of operation devices, a plurality of hydraulic actuators, a hydraulic pump 21A that discharges hydraulic oil, a control valve unit 21B, a tank 21C, a plurality of sensors, a controller 70, and a display 80.

The lower travelling body 11 and the upper slewing body 12 constitute a machine body that supports the work device 13. The lower travelling body 11 includes a traveling device for causing the hydraulic excavator 10 to travel, and is capable of travelling on the ground G. The upper slewing body 12 includes a slewing frame 12A, a cab 12B mounted thereon, and a counterweight. In the cab 12B, there are disposed a seat on which an operator sits, various operation levers, an operation pedal, and the like.

The work device 13 is capable of performing loading work for loading earth and sand into a dump truck, and includes a boom 14, an arm 15, and a bucket 16. The bucket 16 is an example of a distal end attachment. The earth and sand are an example of a work object and the dump truck is an example of a destination. The loading work includes excavation task of excavating earth and sand and holding the excavated earth and sand in the bucket 16, carrying task of carrying the held earth and sand to a position above a dump truck, and soil discharging task of discharging the earth and sand on the dump truck.

The boom 14 has a boom proximal end portion which is a proximal end portion supported by a front portion of the slewing frame 12A so as to be rotatable about a horizontal rotation axis A1, and a boom distal end portion which is a distal end portion on the opposite side of the boom proximal end portion. The arm 15 has an arm proximal end portion which is a proximal end portion attached to the boom distal end portion so as to be rotatable about a horizontal rotation axis A2, and an arm distal end portion which is a distal end portion on the opposite side of the arm proximal end portion. The bucket 16 has a bucket proximal end portion which is a proximal end portion attached to the arm distal end portion by a bucket attachment pin 26 so as to be rotatable about a horizontal rotation axis A3, and a bucket distal end portion which is a distal end portion on the opposite side of the bucket proximal end portion. The bucket proximal end portion is an example of a distal end attachment proximal end portion.

The plurality of operation devices include a boom operation device 85, an arm operation device 86, and a bucket operation device 87. The boom operation device 85 includes an operation lever to which an operation by an operator for designating a raising-and-lowering direction of the boom 14 is given, and a boom operation device main body that inputs, to the controller 70, an operation command signal which is a command signal corresponding to an operation direction and an operation amount given to the operation lever of the boom operation device 85. The arm operation device 86 includes an operation lever to which an operation by an operator for designating a rotation direction of the arm 15 is given, and an arm operation device main body that inputs, to the controller 70, an operation command signal which is a command signal corresponding to an operation direction and an operation amount given to the operation lever of the arm operation device 86. The bucket operation device 87 includes an operation lever to which an operation by an operator for designating a rotation direction of the bucket 16 is given, and a bucket operation device main body that inputs, to the controller 70, an operation command signal which is a command signal corresponding to an operation direction and an operation amount given to the operation lever of the bucket operation device 87.

The plurality of hydraulic actuators include a boom cylinder 17 which is a hydraulic cylinder for raising and lowering the boom 14, an arm cylinder 18 which is a hydraulic cylinder for causing the arm 15 to rotate, a bucket cylinder 19 which is a hydraulic cylinder for causing the bucket 16 to rotate, and a slewing motor 20 which is a hydraulic motor for causing the upper slewing body 12 to slew with respect to the lower travelling body 11. The bucket cylinder 19 is an example of a distal end cylinder.

The boom cylinder 17 is interposed between the slewing frame 12A of the upper slewing body 12 and the boom 14, and extends or contracts upon receiving supply of a hydraulic oil discharged from the hydraulic pump 21A, thereby turning the boom 14 in a rising direction or a falling direction with respect to the slewing frame 12A.

The arm cylinder 18 is interposed between the boom 14 and the arm 15, and extends or contracts upon receiving supply of the hydraulic oil discharged from the hydraulic pump 21A, thereby turning the arm 15 in an arm pulling direction or an arm pushing direction with respect to the boom 14. The arm pulling direction is a direction in which a distal end of the arm 15 approaches the boom 14, and the arm pushing direction is a direction in which the distal end of the arm 15 moves away from the boom 14.

The bucket cylinder 19 is interposed between the arm 15 and the bucket 16, and extends or contracts upon receiving supply of the hydraulic oil discharged from the hydraulic pump 21A, thereby causing the bucket 16 to rotate in a bucket pulling direction or a bucket pushing direction with respect to the arm 15. The bucket pulling direction is a direction in which a distal end of the bucket 16 approaches the boom 14, and the bucket pushing direction is a direction in which the distal end of the bucket 16 moves away from the boom 14.

Specifically, a proximal end portion of the bucket cylinder 19 is rotatably connected to the vicinity of the arm proximal end portion of the arm 15, and a distal end portion of the bucket cylinder 19 is connected to the arm 15 via a first link member 22A and connected to the bucket 16 via a second link member 22B. A proximal end portion of the first link member 22A is rotatably attached to the distal end portion of the bucket cylinder 19 by a link attachment pin 23, and a distal end portion of the first link member 22A is rotatably attached to the arm 15 by a link attachment pin 24. A proximal end portion of the second link member 22B is rotatably attached to the distal end portion of the bucket cylinder 19 by the link attachment pin 23, and a distal end portion of the second link member 22B is rotatably attached to the bucket 16 by a link attachment pin 25. As the bucket cylinder 19 expands and contracts, the first and second link members 22A and 22B transmit a driving force of the bucket cylinder 19 to the bucket 16, so that the bucket 16 rotates around the bucket attachment pin 26 (around the rotation axis A3).

The control valve unit 21B is interposed between the hydraulic pump 21A and the plurality of hydraulic actuators, and adjusts a flow rate of a hydraulic oil supplied to each of the plurality of hydraulic actuators and a supply direction of the hydraulic oil. Specifically, the control valve unit 21B includes a boom control valve that adjusts a flow rate and a supply direction of a hydraulic oil supplied to the boom cylinder 17, an arm control valve that adjusts a flow rate and a supply direction of a hydraulic oil supplied to the arm cylinder 18, and a bucket control valve that adjusts a flow rate and a supply direction of a hydraulic oil supplied to the bucket cylinder 19.

For example, when the operation command signal is input from the bucket operation device 87, the controller 70 inputs a command signal corresponding to the operation command signal to a bucket proportional valve 21D, and a pilot pressure reduced in the bucket proportional valve 21D according to the command signal is input to one of a pair of pilot ports of the bucket control valve. Since a hydraulic oil of the hydraulic pump 21A is supplied to one of a head side chamber and a rod side chamber of the bucket cylinder 19 corresponding to the command signal at a flow rate corresponding to the command signal, the bucket 16 rotates at a speed corresponding to the command signal in a direction corresponding to the command signal. The operations of the boom 14 and the arm 15 by the boom control valve and the arm control valve are the same as that of the bucket 16.

In addition, when performing pressure release control for releasing a pressure in the bucket cylinder 19, the controller 70 outputs, to the bucket proportional valve 21D (solenoid proportional pressure reducing valve), a command signal for adjusting a position of a spool of the bucket control valve so as to block an oil passage between the bucket cylinder 19 and the hydraulic pump 21A and to allow a hydraulic oil in the bucket cylinder 19 to return to the tank 21C. In a case where a pressure release valve for pressure release is provided separately from the bucket control valve, the controller 70 outputs a command signal to the pressure release valve so as to block the oil passage between the bucket cylinder 19 and the hydraulic pump 21A and to allow the hydraulic oil in the bucket cylinder 19 to return to the tank 21C via the pressure release valve. As a result, the pressures in the head side chamber and the rod side chamber of the bucket cylinder 19 are released, so that the bucket 16 is disposed to hang down from the arm 15 by its own weight.

As illustrated in FIG. 2, the plurality of sensors include a boom angle sensor 61, an arm angle sensor 62, a bucket angle sensor 63 (distal end attachment angle sensor), a boom head pressure sensor 64 (boom H pressure sensor), and a boom rod pressure sensor 65 (boom R pressure sensor). The boom head pressure sensor 64 and the boom rod pressure sensor 65 are examples of a holding pressure detector. The holding pressure detector inputs a detection signal regarding a holding pressure of the boom cylinder 17 to the controller 70.

The boom angle sensor 61 generates a detection signal for a boom angle which is an angle of the boom 14, and inputs the detection signal to the controller 70. The boom angle sensor 61 is disposed, for example, at the boom proximal end portion. As illustrated in FIG. 1, although the boom angle can be expressed by an angle θ1 formed by a straight line 14L passing through the boom proximal end portion and the boom distal end portion and a horizontal plane H, the boom angle may be expressed by an angle θ1 formed by the straight line 14L and another reference line (reference plane). Specifically, the straight line 14L may be, for example, a straight line passing through the rotation axis A1 and the rotation axis A2 in the side view of FIG. 1.

The arm angle sensor 62 generates a detection signal for an arm angle which is an angle of the arm 15, and inputs the detection signal to the controller 70. The arm angle sensor 62 is disposed, for example, at the arm proximal end portion. The arm angle can be expressed by an angle θ2 formed by a straight line 15L passing through the arm proximal end portion and the arm distal end portion and the straight line 14L. Specifically, the straight line 15 L may be, for example, a straight line passing through the rotation axis A2 and the rotation axis A3 in the side view of FIG. 1.

The bucket angle sensor 63 generates a detection signal for a bucket angle which is an angle of the bucket 16, and inputs the detection signal to the controller 70. The bucket angle sensor 63 is disposed, for example, in the vicinity of the link attachment pin 24, and is capable of generating a detection signal for the bucket angle by detecting the rotation of the first link member 22A or the rotation of the link attachment pin 24. The bucket angle sensor 63, however, may be configured to generate the detection signal for the bucket angle by detecting, for example, the rotation of the link attachment pin 23, the rotation of the link attachment pin 25, or the rotation of the bucket 16 about the rotation axis A3. The bucket angle can be expressed by an angle θ3 formed by a straight line 16L passing through the bucket proximal end portion and the bucket distal end portion and the straight line 15L. Specifically, the straight line 16L may be, for example, a straight line passing through the rotation axis A3 and the distal end portion of the bucket 16 in the side view of FIG. 1.

The boom head pressure sensor 64 generates a detection signal regarding a head pressure which is a pressure of a head side chamber of the boom cylinder 17, and inputs the detection signal to the controller 70. The boom rod pressure sensor 65 generates a detection signal for a rod pressure which is a pressure of a rod side chamber of the boom cylinder 17, and inputs the detection signal to the controller 70.

The boom angle sensor 61, the arm angle sensor 62, and the bucket angle sensor 63 (distal end attachment angle sensor) are examples of an attitude detector that detects attitudes of the boom 14, the arm 15, and the bucket 16 (distal end attachment). The attitude detector, however, is not limited to the angle sensors 61, 62, and 63 as described above. The attitude detector may be configured with, for example, a plurality of sensors capable of detecting strokes of the boom cylinder 17, the arm cylinder 18, and the bucket cylinder 19. Furthermore, the attitude detector may include, for example, a receiver capable of receiving a satellite signal from a satellite positioning system such as GNSS. Furthermore, the attitude detector may include, for example, an inertial measurement unit (IMU).

The display 80 is disposed at a position where the display is operable by an operator sitting on a seat in the cab 12B. The display 80 is configured to be capable of sending and receiving an electrical signal to and from the controller 70. Specifically, the display 80 is capable of receiving, for example, an image signal related to a display image from the controller 70 and displaying the image on a screen. In addition, the display 80 includes an input device that input, to the controller 70, a command signal corresponding to an image touched by an operator, the image being displayed on a part of the screen of the display 80, for example.

The hydraulic excavator 10 includes a start input reception part for the operator to designate start of distal end calibration (an example of specifying processing) which is calibration for specifying a weight and a gravity center position of the bucket 16. Upon receiving input by the operator, the start input reception part inputs, to the controller 70, a start command signal, which is a signal for commanding start of the distal end calibration. In the present embodiment, the start input reception part includes a switch 81 mounted on the display 80. Specifically, for example, the start input reception part may include a switch image displayed on the screen of the display 80 as the switch 81, or may be an input device including a switch disposed at a place different from the display 80.

The controller 70 includes, for example, a CPU, a memory, and the like. The controller 70 is provided for specifying the weight and the gravity center position of the bucket 16, and includes a property calculation section 71, a data storage section 72, and a guidance output section 73.

The property calculation section 71 performs various calculations for performing the distal end calibration to specify the weight and the gravity center position of the bucket 16.

The data storage section 72 temporarily stores various data in the process of the distal end calibration, and stores data related to the weight and the gravity center position of the bucket 16 specified by the distal end calibration. The data storage section stores in advance data related to the boom 14 including a size of the boom 14, a weight of the boom 14, and a gravity center position of the boom 14, and data related to the arm 15 including a size of the arm 15, a weight of the arm 15, and a gravity center position of the arm 15. The data related to the size of the boom 14 includes a distance from the rotation axis A1 to the rotation axis A2, and the data related to the size of the arm 15 includes a distance from the rotation axis A2 to the rotation axis A3.

When the distal end calibration is performed, the guidance output section 73 outputs information for displaying an explanation of a procedure of the distal end calibration on the display 80.

[Specifying Weight and Gravity Center Position of Distal End Attachment]

Next, a method of specifying the weight and the gravity center position of the bucket 16, which is an example of the distal end attachment, will be described with reference to FIG. 3 to FIG. 5.

When the operator presses the switch 81 of the start input reception part, the start input reception part inputs, to the controller 70, a start command signal for commanding that distal end calibration should be started.

Upon receiving input of the start command signal, the controller 70 automatically starts the distal end calibration. Upon receiving input of the start command signal, the controller 70 first executes a pressure releasing mode (pressure release control). The pressure releasing mode is a control mode for executing pressure release for releasing the pressure in the bucket cylinder 19.

In the pressure releasing mode, when the operator operates the operation lever of the bucket operation device 87 and an operation command signal thereof is input to the controller 70, the controller 70 outputs such a command signal that allows the hydraulic oil (hydraulic oil on a holding side) in the bucket cylinder 19 to return to the tank 21C through the bucket control valve or the pressure release valve. In other words, the controller 70 outputs the command signal to the bucket proportional valve 21D or the pressure release valve in response to the operation command signal output from the bucket operation device 87 by the operation of the operation lever by the operator. As a result, the pressure in the bucket cylinder 19 is released, and the bucket 16 rotates by its own weight and is disposed so as to hang down from the distal end portion (arm top position) of the arm 15. In other words, the bucket 16 freely falls around the rotation axis A3 and stops. At this time, as illustrated in FIG. 3, the center of gravity of the bucket 16 is positioned directly below the rotation axis A3, that is, on a vertical line passing through the rotation axis A3. The position of the bucket 16 illustrated in FIG. 3 is referred to as a pressure release position.

Figure 3:
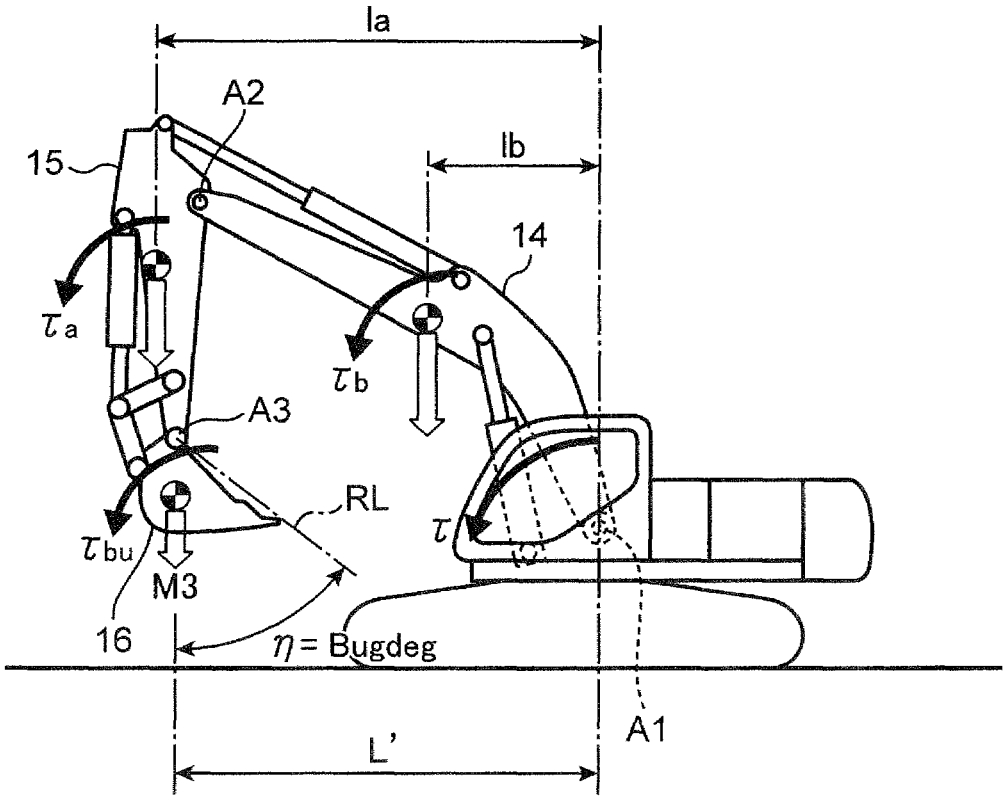
FIG. 3 is a view illustrating a specifying method for specifying a weight and a gravity center position of a distal end attachment in the hydraulic excavator.

In a state where the bucket 16 is disposed at the pressure release position illustrated in FIG. 3, a horizontal distance between the boom proximal end portion (boom foot) and the arm distal end portion (arm top) is defined as L'. In other words, the horizontal distance L' is a horizontal distance between the rotation axis A1 and the rotation axis A3, and is a horizontal distance between the boom proximal end portion and the bucket proximal end portion. The property calculation section 71 of the controller 70 calculates the horizontal distance L' based on a detection signal input from the boom angle sensor 61 and a detection signal input from the arm angle sensor 62.

Next, the property calculation section 71 calculates a holding force of the boom cylinder 17 based on a detection signal from the boom head pressure sensor 64 and a detection signal from the boom rod pressure sensor 65 in a state where the bucket 16 is disposed at the pressure release position. In addition, the property calculation section 71 calculates a total moment $\tau$, which is a moment of the work device 13 around the boom foot (around the rotation axis A1), based on the calculated holding force of the boom cylinder 17 and a distance between the boom foot and a cylinder axis of the boom cylinder 17.

Here, the total moment $\tau$ is obtained by adding a boom moment $\tau b$ which is a moment of the boom 14 around the boom proximal end portion (around the rotation axis A1), an arm moment $\tau a$ which is a moment of the arm 15 around the boom proximal end portion (around the rotation axis A1), and a bucket moment $\tau bu$ which is a moment of the bucket 16 around the boom proximal end portion (around the rotation axis A1) ($\tau=\tau b+\tau a+\tau bu$). Accordingly, the bucket moment $\tau bu$ is expressed by the following Formula (1).

$$\tau bu=\tau-\tau b-\tau a \tag{1}$$

In addition, since the bucket moment $\tau bu$ acts as the moment around the boom proximal end portion (around the rotation axis A1), the bucket moment $\tau bu$ is expressed by Formula (2) using the horizontal distance L' and a weight M3 of the bucket 16 (proximal end weight M3), and Formula (2) can be rewritten as Formula (3).

$$\tau bu=M3\times L' \tag{2}$$

$$M3=\tau bu/L' \tag{3}$$

Since the weight and the gravity center position of the boom 14 and the weight and the gravity center position of the arm 15 are stored in the data storage section 72 in advance, the boom moment $\tau b$ and the arm moment $\tau a$ can be calculated based on the weight and the gravity center position of the boom 14, the weight and the gravity center position of the arm 15, the detection signal input from the boom angle sensor 61, and the detection signal input from the arm angle sensor 62, respectively.

In addition, the boom angle $\theta 1$ of the boom 14 and the arm angle $\theta 2$ of the arm 15 are adjusted to preset attitudes with high detection accuracy (a specific boom angle $\theta 1s$, a specific arm angle $\theta 2s$), and the distal end calibration is performed in this state. In this case, the data storage section 72 stores the specific boom angle $\theta 1s$ and the specific arm angle $\theta 2s$ in advance. The specific boom angle $\theta 1s$ and the specific arm angle $\theta 2s$ are set as follows, for example. In a state where the bucket 16 (distal end attachment) is not attached to the arm 15, a plurality of pieces of data such as the boom moment $\tau b$ around the boom proximal end portion and the arm moment $\tau a$ around the boom proximal end portion are acquired in advance by actual measurement or the like at a plurality of attitudes in which the setting of the angle of the boom 14 and the angle of the arm 15 is changed. An attitude with high detection accuracy can be selected from the plurality of acquired actual measurement data, and the angle of the boom 14 and the angle of the arm 15 corresponding to the selected attitude can be stored in the data storage section 72 of the controller 70 in advance as the specific boom angle θ1*s* and the specific arm angle θ2*s*. As described above, by performing the distal end calibration while adjusting the boom angle θ1 and the arm angle θ2 to a condition under which the moments τb and τa with high accuracy can be obtained (specific boom angle θ1*s*, specific arm angle θ2*s*), a combined moment (total moment τ,τ') obtained when the bucket 16 is attached to the arm 15 can be calculated with high accuracy.

The property calculation section 71 calculates the bucket moment τbu from Formula (1), the total moment τ, the boom moment τb, and the arm moment τa, and calculates the weight M3 of the bucket 16 from the calculated bucket moment τbu and Formula (3).

Here, as illustrated in FIG. 3, a straight line connecting the rotation axis A3 of the bucket 16 and the distal end portion of the bucket 16 is defined as a reference line RL, and an angle between the reference line RL and a vertical line is defined as a ground angle η. In a case where the bucket 16 is disposed at the pressure release position, the gravity center position of the bucket 16 is located on the vertical line passing through the rotation axis A3 of the bucket 16. Therefore, the ground angle η of the bucket 16 coincides with a bucket gravity center angle Bugdeg which is an angle between the reference line RL and a straight line passing through the rotation axis A3 and the gravity center position of the bucket 16.

The bucket gravity center angle Bugdeg is calculated as follows, for example. The property calculation section 71 can calculate the bucket gravity center angle Bugdeg based on a detection signal input from the bucket angle sensor 63 in a state where the bucket 16 is disposed at a position (reference position) where the reference line RL is directed in a vertical direction and a detection signal input from the bucket angle sensor 63 in a state where the bucket 16 is disposed at the pressure release position.

When the calculation of the weight M3 of the bucket 16 and the calculation of the bucket gravity center angle Bugdeg are completed, the controller 70 ends the pressure releasing mode (pressure release control).

Next, the bucket 16 is disposed at a displacement position that is a position different from the pressure release position. The displacement position is a position obtained where the bucket 16 is displaced from the pressure release position in the bucket pulling direction or the bucket pushing direction. FIG. 4 illustrates, as the displacement position, a position obtained where the bucket 16 rotates about the rotation axis A3 from the pressure release position in FIG. 3 and is displaced in the bucket pushing direction. It is noted that the displacement position of the bucket 16 may be a position obtained where the bucket rotates about the rotation axis A3 from the pressure release position and is displaced in the bucket pulling direction.

When the bucket 16 is displaced from the pressure release position to the displacement position, the center of gravity of the bucket 16 moves, so that the moment of the work device 13 around the boom foot (around the rotation axis A1) changes from the total moment τ to a total moment τ'. Since in the process of displacement of the bucket 16 from the pressure release position to the displacement position, the boom 14 and the arm 15 are not displaced, the boom moment τb and the arm moment τa do not change. Meanwhile, when the bucket 16 is displaced from the pressure release position to the displacement position, the gravity center position of the bucket 16 is displaced by a horizontal movement distance x as illustrated in FIG. 4. Accordingly, a difference between the total moment τ' and the total moment τ is caused by a change of the moment of the bucket 16 around the boom foot (around the rotation axis A1) from the bucket moment τbu to a bucket moment τ'bu as the gravity center position of the bucket 16 is displaced. Accordingly, the following formula (4) is established.

$$\tau'bu=\tau'-\tau b-\tau a \tag{4}$$

The property calculation section 71 calculates the holding force of the boom cylinder 17 based on the detection signal from the boom head pressure sensor 64 and the detection signal from the boom rod pressure sensor 65 in a state where the bucket 16 is disposed at the displacement position. In addition, the property calculation section 71 calculates the total moment τ', which is a moment of the work device 13 around the boom foot (around the rotation axis A1), based on the calculated holding force of the boom cylinder 17 and the distance between the boom foot and the cylinder axis of the boom cylinder 17.

Since the bucket moment τ'bu acts as a moment around the boom proximal end portion (around the rotation axis A1), the bucket moment τ'bu is expressed by Formula (5) using the horizontal distance (L'+x) and the weight M3 of the bucket 16.

$$\tau'bu=M3\times(L'+x) \tag{5}$$

The Formula (5) can be rewritten as the following Formula (6).

$$x=\tau'bu/M3-L' \tag{6}$$

The property calculation section 71 calculates the horizontal movement distance x from the calculated total moment τ' and Formulas (4) and (6).

Figure 4:
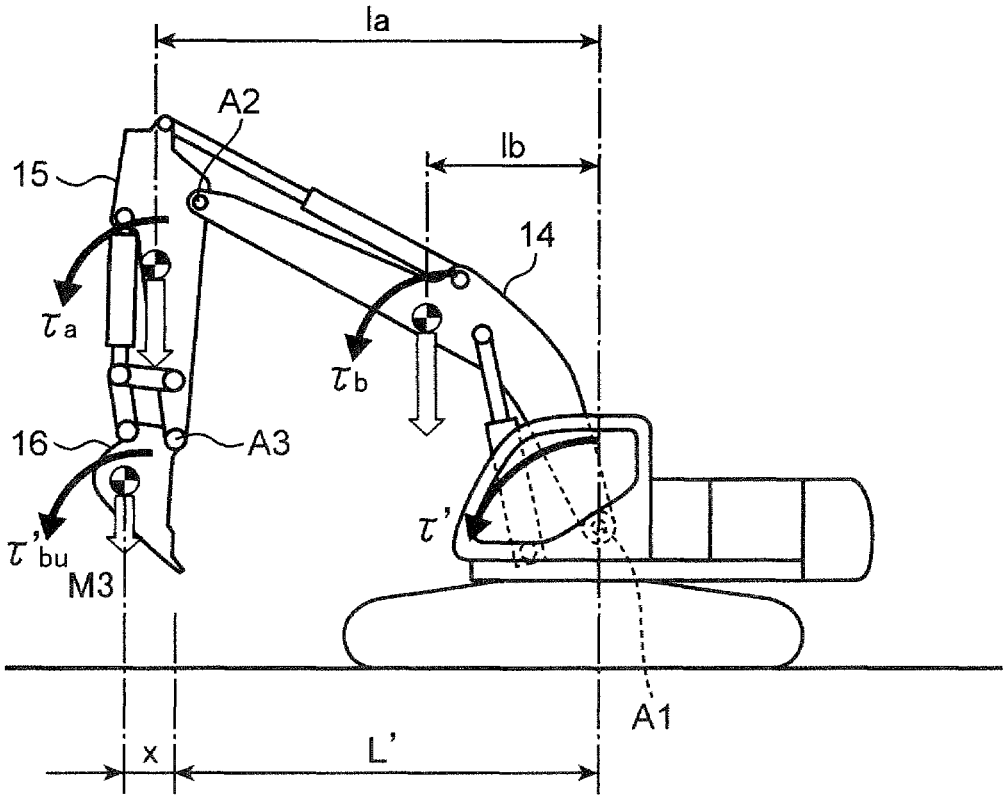
FIG. 4 is a view illustrating the specifying method for specifying the weight and the gravity center position of the distal end attachment in the hydraulic excavator.

Here, a gravity center change angle, which is a change angle of the gravity center position changed by displacing the bucket 16 from the pressure release position illustrated in FIG. 3 to the displacement position illustrated in FIG. 4, is defined as ΔBudeg. A length from the bucket attachment pin 26 (rotation axis A3) to the gravity center position of the bucket 16 is defined as L as illustrated in FIG. 5. In this case, the length L is expressed by the following Formula (7) using the horizontal movement distance x and the gravity center change angle ΔBudeg.

$$L=x/\sin(\Delta Budeg) \tag{7}$$

The property calculation section 71 calculates the gravity center change angle ΔBudeg based on the detection signal input from the bucket angle sensor 63. Then, the property calculation section 71 calculates the length L from the calculated gravity center change angle ΔBudeg and Formula (7).

Figure 5:
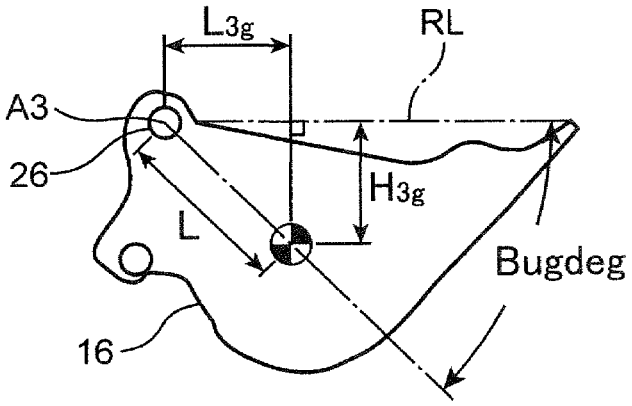
FIG. 5 is a view illustrating the specifying method for specifying the weight and the gravity center position of the distal end attachment in the hydraulic excavator.

Here, with reference to FIG. 5, the length L, the reference line RL, and the bucket gravity center angle Bugdeg have relationships of the following Formulas (8) and (9).

$$L3g=L\cdot\cos(\text{Bugdeg}) \tag{8}$$

$$H3g=L\cdot\sin(\text{Bugdeg}) \tag{9}$$

L3*g* is a component of the length L in a direction parallel to the reference line RL, and H3*g* is a component of the length L in a direction perpendicular to the reference line RL. The property calculation section 71 calculates a parallel component L3*g* of the length L and a perpendicular component H3*g* of the length L from the calculated length L and Formulas (8) and (9). As a result, the gravity center position of the bucket 16 is specified by these components L3g and H3g.

As described in the foregoing, in the hydraulic excavator 10 according to the present embodiment, the weight and the gravity center position of the bucket 16 can be specified without using a detection result by the pressure sensor that detects a pressure of the bucket cylinder. For example, in the technique recited in Japanese Patent Application Laid-Open No. 2007-178362, since a holding pressure of the bucket cylinder is detected when the gravity center position of the distal end attachment is specified, it is necessary to dispose the pressure sensor and wiring accompanying the pressure sensor at a position near the bucket, the position being where the pressure sensor is liable to be damaged, resulting in leading to an increase in cost. On the other hand, the hydraulic excavator 10 according to the present embodiment needs no pressure sensor that detects a pressure of the bucket cylinder. However, the present invention does not exclude disposing a pressure sensor that detects a pressure of a bucket cylinder, and also includes a work machine provided with a pressure sensor that detects a pressure of a bucket cylinder when necessary in an application other than application for specifying a weight and a gravity center position of the distal end attachment.

[Guidance Function]

Next, a guidance function regarding specifying a weight and a gravity center position of a distal end attachment will be described with reference to FIG. 6 and FIG. 7.

In the hydraulic excavator 10 according to the present embodiment, by displaying, on the screen of the display 80, a process of specifying the weight and the gravity center position of the distal end attachment described above, the operator can proceed with the process following the explanation on the screen (cluster screen guidance function). In addition, as described above, this guidance is automatically started when the operator presses the switch 81 of the start input reception part, and first, the pressure releasing mode is executed. Accordingly, the execution of the process is simplified and time thereof is shortened, so that a configuration convenient for the operator is secured. Specific description is as follows.

Figure 6:
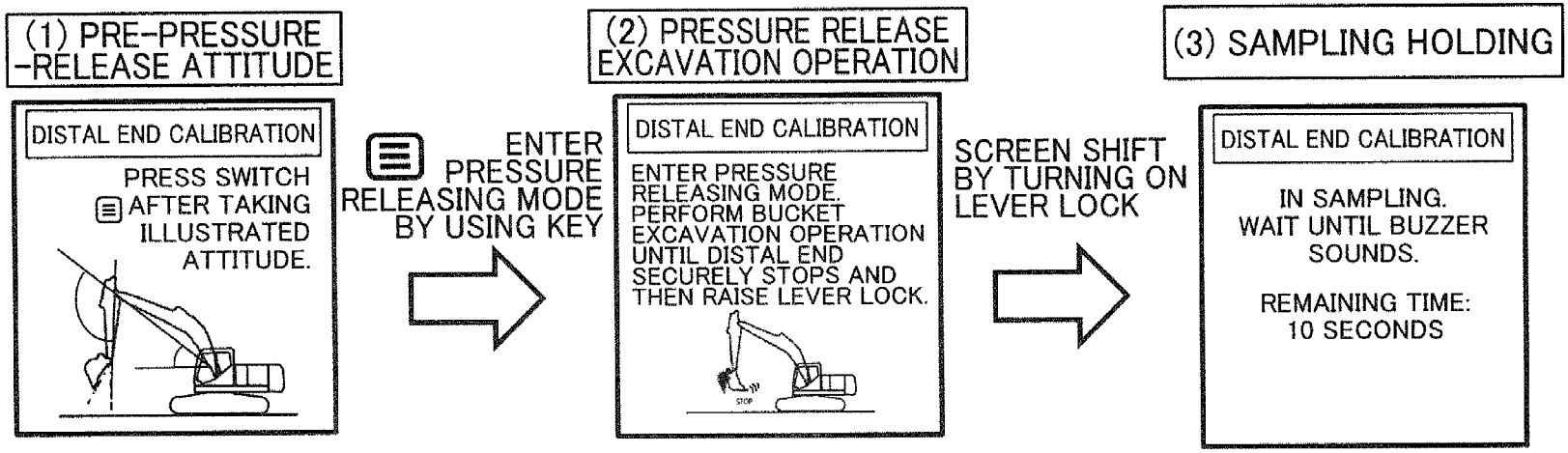
FIG. 6 is a diagram illustrating an example of a display screen for describing a procedure of the specifying method to an operator.

"(1) Pre-pressure-release attitude" illustrated in the left diagram in FIG. 6 shows a display screen of the display 80 before the calibration is started. The display screen (1) displays guidance for notifying the operator to adjust the boom angle θ1 of the boom 14 to the specific boom angle θ1*s* (e.g., 40 degrees) and to adjust the arm angle θ2 of the arm 15 to the specific arm angle θ2*s* (e.g., 147 degrees). The display screen (1) displays guidance for notifying the operator to adjust the specific boom angle θ1*s* to fall within a range of, e.g., the boom angle θ1=38 to 42 degrees and to adjust the specific arm angle θ2*s* to fall within a range of, e.g., 145 to 149 degrees. In accordance with the guidance display, the operator operates the boom operation device 85 and the arm operation device 86 so that the boom angle θ1 of the boom 14 is adjusted to the specific boom angle θ1*s* and the arm angle θ2 of the arm 15 is adjusted to the specific arm angle θ2*s*. The display screen (1) also displays guidance for notifying the operator to press the switch 81 after adjusting the boom angle θ1 and the arm angle θ2. The guidance output section 73 of the controller 70 outputs, to the display 80, such an image signal that makes the display screen (1) be displayed on the display 80.

"(2) Pressure release excavation operation" illustrated in the diagram at the center of FIG. 6 shows a display screen of the display 80 immediately after the calibration is started. The display screen (2) displays guidance for notifying the operator that the control mode is set to the pressure releasing mode. In addition, the display screen (2) displays guidance for notifying the operator to operate the operation lever of the bucket operation device 87 in the bucket pulling direction (excavation operation direction), to continuously perform the operation until the bucket 16 is disposed so as to hang down from the arm distal end portion and swing of the bucket 16 is stopped, and to perform operation of turning on the lever lock (operation of raising the lever lock) after the bucket 16 is stopped. The guidance output section 73 outputs such an image signal that makes the display screen (2) be displayed on the display 80 to the display 80. The specific example illustrated in the diagram at the center of FIG. 6 shows a case where the pressure of the bucket cylinder 19 is released by operating the operation lever of the bucket operation device 87 in the bucket pulling direction. Further, the lever lock is a lever disposed at a position at which an operator is allowed to operate the lever in the cab 12B. Turning on the lever lock brings about a state where the operation applied to the operation lever is not accepted. Specifically, with the lever lock being turned on, even if the operator applies an operation to the operation lever of the operation device such as the boom operation device 85, the arm operation device 86, and the bucket operation device 87, the work device 13 of the hydraulic excavator 10 does not operate. When the lever lock is turned on, the following sampling is performed.

"(3) Sampling holding" illustrated in the right diagram in FIG. 6 is a display screen automatically displayed when a signal indicating that the lever lock is turned on is input to the controller 70. The display screen (3) displays guidance for notifying the operator to wait until a buzzer sounds. The guidance output section 73 outputs such an image signal that makes the display screen (3) be displayed on the display 80 to the display 80. During this waiting time, the property calculation section 71 of the controller 70 performs the above-described various calculation processing in a state where the bucket 16 is disposed at the pressure release position, and acquires the weight M3 of the bucket 16. When the waiting time elapses, the buzzer sounds, so that the operator recognizes that operation of turning off the lever lock (operation of lowering the lever lock) is allowed. The operator performs the operation of turning off the lever lock.

Figure 7:
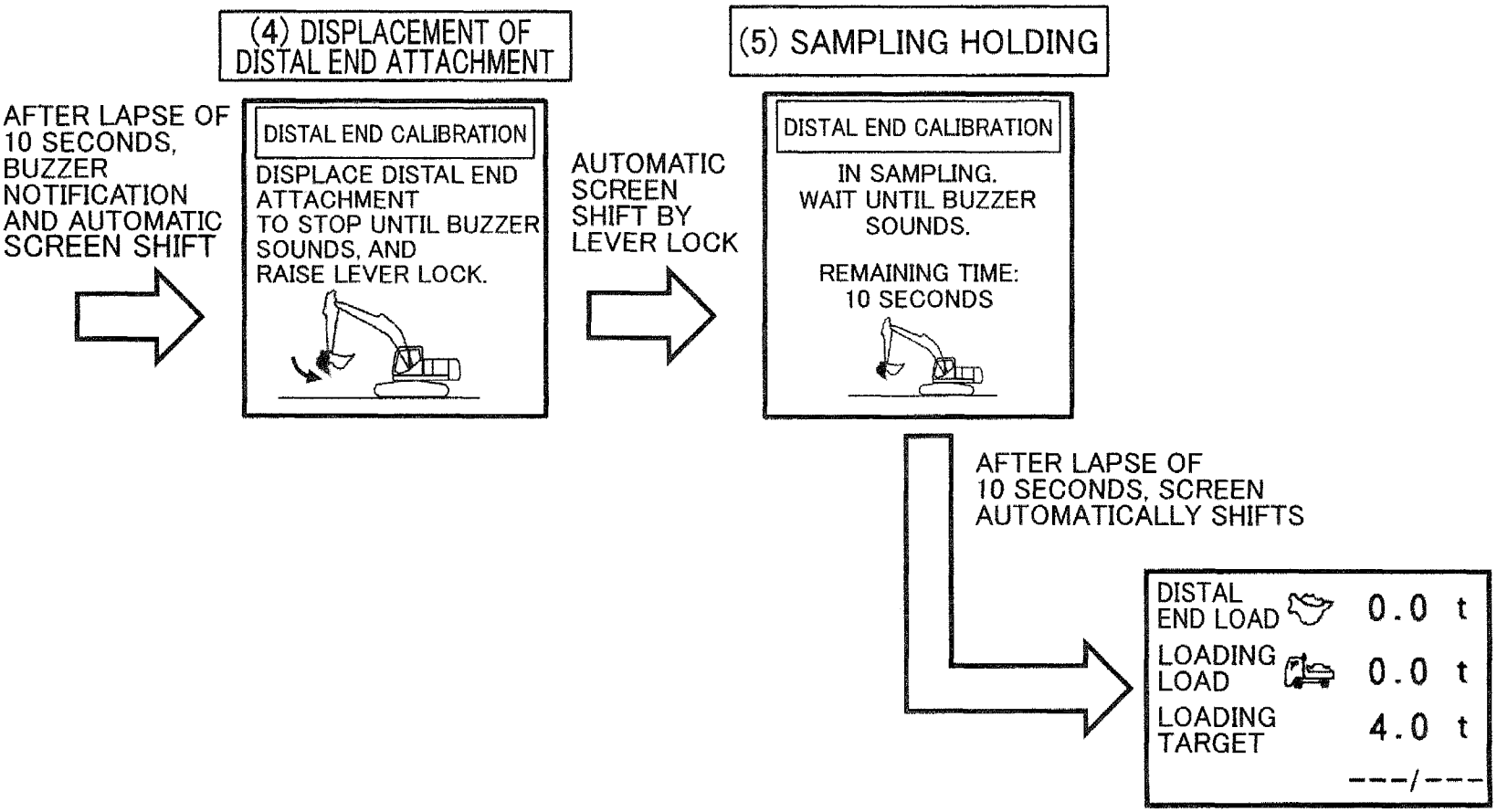
FIG. 7 is a diagram illustrating an example of the display screen for describing the procedure of the specifying method to the operator.

"(4) Displacement of Distal end attachment" illustrated in the left diagram in FIG. 7 is a display screen automatically displayed after the waiting time elapses. The display screen (4) displays guidance for notifying the operator to displace the bucket 16 from the pressure release position to the displacement position. The specific example illustrated in the left diagram in FIG. 7 shows, as the displacement position, a position obtained when the bucket 16 rotates from the pressure release position shown in the diagram at the center of FIG. 6 and is displaced in the bucket pulling direction. The display screen (4) further displays guidance for notifying the operator to operate the operation lever of the bucket operation device 87 in the bucket pulling direction until the buzzer sounds (until the notification is made by a notification device on condition that the bucket 16 is displaced from the pressure release position to the displacement position), to return the operation lever to a neutral position at the time point notified by the notification device, and then to perform the operation to turn on the lever lock (the operation to raise the lever lock). As a result of execution of these operations by the operator, the bucket 16 is disposed at the displacement position. The guidance output section 73 outputs such an image signal that makes the display screen (4) be displayed on the display 80 to the display 80.

"(5) Sampling holding" illustrated in the diagram at the center of FIG. 7 is a display screen automatically displayed when the signal indicating that the lever lock is turned on is input to the controller 70. The display screen (5) displays guidance for notifying the operator to wait until the buzzer sounds. The guidance output section 73 outputs such an image signal that makes the display screen (5) be displayed on the display 80 to the display 80. During this waiting time, the property calculation section 71 of the controller 70 performs the above-described various calculation processing in a state where the bucket 16 is disposed at the displacement position, and acquires the gravity center position of the bucket 16, i.e., the parallel component L3*g* of the length L and the perpendicular component H3*g* of the length L. When the waiting time elapses, the distal end calibration, that is, the processing for specifying the weight and the gravity center position of the distal end attachment is completed. Since the buzzer sounds when the processing is completed, the operator can recognize the completion of the distal end calibration.

The display screen illustrated in the lower right part of FIG. 7 is a display screen automatically displayed after the completion of the distal end calibration. This display screen is a display screen for the loading work performed after the distal end calibration. The hydraulic excavator 10 according to the present embodiment includes a payload device (load measuring device) that measures a load of the earth and sand held by the bucket 16. Since various known techniques can be adopted by a payload device that measures a load of earth and sand, no detailed description of the device will be made. The hydraulic excavator 10 performs excavation task of excavating earth and sand and holding the excavated earth and sand in the bucket 16, carrying task of carrying the held earth and sand to a position above a dump truck, and soil discharging task of discharging the earth and sand on the dump truck. On the display screen in the lower right part of FIG. 7, a load of the earth and sand held by the bucket 16 is displayed as a "distal end load", a total load discharged to the dump truck (a total weight of the earth and sand) is displayed as a"loading load", and a target load of the earth and sand to be loaded onto the dump truck is displayed as a "loading target" in real time.

As described in the foregoing, in the hydraulic excavator 10 according to the present embodiment, the property calculation section 71 of the controller 70 calculates the horizontal distance L' between the boom proximal end portion and the arm distal end portion based on the detection signals input from the boom angle sensor 61 and the arm angle sensor 62, calculates the weight M3 of the bucket 16 based on the horizontal distance L' and the detection signals input from the boom head pressure sensor 64 and the boom rod pressure sensor 65 in a state where the bucket 16 is disposed at the pressure release position which is a position obtained when the pressure of the bucket cylinder 19 is released, and calculates the gravity center position of the bucket 16 based on the weight M3 of the bucket 16, the detection signals input from the boom head pressure sensor 64 and the boom rod pressure sensor 65, and the detection signal input from the bucket angle sensor 63 in a state where the bucket 16 is disposed at the displacement position which is a position different from the pressure release position.

In other words, the property calculation section 71 can calculate the weight M3 of the bucket 16 based on the horizontal distance L' and a holding pressure of the boom cylinder 17 obtained when the bucket 16 is disposed at the pressure release position, and can calculate the gravity center position of the bucket 16 based on the holding pressure of the boom cylinder 17 obtained when the bucket 16 is disposed at the displacement position, position data regarding the displacement of the bucket 16, and the calculated weight M3. Therefore, it is not necessary to use a pressure sensor that detects a pressure of a bucket cylinder as used in the related art, and a weight and a gravity center position of a distal end attachment can be specified with a simple configuration.

Furthermore, in the present embodiment, the distal end calibration (specifying processing) is started by the operator's input to the start input reception part even without complicated operation by the operator, and moreover, the operator can cause the controller 70 to specify the weight and the gravity center position of the bucket 16 only by operating the hydraulic excavator 10 according to the guidance of the specifying processing displayed on the display 80. The content of the guidance is to notify the operator of a simple operation of displacing the bucket 16 from the pressure release position to the displacement position. As a result, operability can be improved by simplifying the operation required for the operator, and time required for the specifying processing can be shortened.

Furthermore, in the present embodiment, the specifying processing is performed in a state where the attitude of the boom 14 is adjusted to a preset attitude and the attitude of the arm 15 is adjusted to a preset attitude with high detection accuracy (the specific boom angle θ1*s*, the specific arm angle θ2*s*). As a result, for example, it is possible to acquire a plurality of pieces of data such as the boom moment τb around the boom proximal end portion and the arm moment τa around the boom proximal end portion in advance by actual measurement or the like, select an attitude having high detection accuracy, and store the selected attitude in the data storage section 72 of the controller 70, and it is possible to accurately specify the weight and the gravity center position of the bucket 16 at the stored attitude having high detection accuracy.

The present disclosure is not limited to the embodiment described above. The present disclosure includes, for example, the following aspects.

(A) Work Machine

Although the work machine according to the above embodiment is the hydraulic excavator 10, the work machine may be a work machine other than the hydraulic excavator.

(B) Distal End Attachment

Although the distal end attachment according to the embodiment is the bucket 16, the distal end attachment may be another distal end attachment, for example, a lifting magnet, a fork, or a grapple.

(C) Boom Angle and Arm Angle

Although in the embodiment, the property calculation section 71 calculates a weight and a gravity center position of a distal end attachment in a state where the angle θ1 of the boom 14 is adjusted to the specific boom angle θ1*s* and the angle θ2 of the arm 15 is adjusted to the specific arm angle θ2*s*, the present invention is not limited to such a form. The property calculation section may calculate the weight and the gravity center position of the distal end attachment in a state where the angle of the boom is adjusted to an arbitrary angle other than the specific boom angle θ1*s* and the angle of the arm is adjusted to an arbitrary angle other than the specific arm angle θ2*s*.

(D) Pressure Releasing Mode (Pressure Release Control)

Although in the embodiment, the controller 70 outputs a command signal to the bucket proportional valve 21D or to the pressure release valve so as to release the pressure in the bucket cylinder 19 according to the operation of the operation lever by the operator in the pressure releasing mode (pressure release control), the embodiment is not limited thereto. Upon receiving input of the start command signal from the start input reception part, the controller 70 may output the command signal to the bucket proportional valve 21D or the pressure release valve so as to release the pressure in the bucket cylinder 19 even without the operation of the operation lever by the operator.

Furthermore, although in the embodiment, the guidance is displayed so that the operation lever of the bucket operation device 87 is operated in the bucket pulling direction in the pressure releasing mode, the guidance may be displayed so that the operation lever is operated in the bucket pushing direction.

As described in the foregoing, according to the present disclosure, there is provided a work machine capable of specifying a weight and a gravity center position of a distal end attachment with a simple configuration.

Provided is a work machine including: a machine body; a boom having a boom proximal end portion which is a proximal end portion supported by the machine body so as to be raised and lowered; an arm having an arm proximal end portion rotatably supported by a distal end portion of the boom and an arm distal end portion which is a distal end portion on an opposite side of the arm proximal end portion; a distal end attachment having a distal end attachment proximal end portion which is a proximal end portion rotatably supported by the arm distal end portion; a boom cylinder which is a hydraulic cylinder that operates so as to raise and lower the boom with respect to the machine body; an arm cylinder which is a hydraulic cylinder that operates so as to rotate the arm with respect to the boom; a distal end cylinder which is a hydraulic cylinder that operates so as to rotate the distal end attachment with respect to the arm; an attitude detector that detects attitudes of the boom, the arm, and the distal end attachment; a holding pressure detector that detects a holding pressure of the boom cylinder, and a controller including a property calculation section, in which the property calculation section includes: calculating a horizontal distance between the boom proximal end portion and the arm distal end portion based on a detection signal input from the attitude detector; calculating a weight of the distal end attachment based on the horizontal distance and a detection signal input from the holding pressure detector in a state where the distal end attachment is disposed at a pressure release position which is a position when a pressure of the distal end cylinder is released; and calculating a gravity center position of the distal end attachment based on the weight of the distal end attachment, a detection signal input from the holding pressure detector, and a detection signal input from the attitude detector in a state where the distal end attachment is disposed at a displacement position which is a position different from the pressure release position.

In the work machine, the property calculation section of the controller can calculate the weight of the distal end attachment based on the horizontal distance and a holding pressure of the boom cylinder obtained when the distal end attachment is disposed at the pressure release position, and can calculate the gravity center position of the distal end attachment based on the holding pressure of the boom cylinder obtained when the distal end attachment is disposed at the displacement position, position data regarding the displacement of the distal end attachment, and the calculated weight. Therefore, it is not necessary to use a pressure sensor that detects a pressure of a bucket cylinder as used in the related art, and a weight and a gravity center position of a distal end attachment can be specified with a simple configuration. The holding pressure detector may include, for example, at least one pressure sensor that detects a holding pressure of the boom cylinder.

It is preferable that the work machine further includes a start input reception part that receives an input for an operator to designate start of specifying processing which is processing for specifying the weight and the gravity center position of the distal end attachment, and outputs a command signal corresponding to the input to the controller, and that the controller is configured to start the specifying processing when the command signal is input, and the controller further includes a guidance output section that outputs, to a display, such an image signal that makes an image related to guidance of the specifying processing be displayed on the display when the specifying processing is started. In this configuration, the specifying processing is started by the operator's input to the start input reception part even without complicated operation by the operator, and moreover, the operator can cause the controller to specify the weight and the gravity center position of the distal end attachment only by operating the work machine according to the guidance of the specifying processing displayed on the display. As a result, operability can be improved by simplifying the operation required for the operator, and time required for the specifying processing can be shortened.

The controller preferably performs pressure release control for releasing the pressure of the distal end cylinder in the specifying processing when the command signal is input. In this configuration, when the operator makes an input to the start input reception part, the pressure release control is automatically performed (the pressure releasing mode is automatically set). Therefore, the operation required of the operator is further simplified, and time required for the specifying processing is further shortened.

It is preferable that the controller further includes a data storage section that stores a specific boom angle which is a preset angle of the boom and a specific arm angle which is a preset angle of the arm, and that the property calculation section calculates the weight and the gravity center position of the distal end attachment in a state where the angle of the boom is adjusted to the specific boom angle and the angle of the arm is adjusted to the specific arm angle. In this configuration, the specifying processing can be performed in a state where the attitude of the boom and the attitude of the arm are adjusted to a preset attitude with high detection accuracy. Specifically, for example, a plurality of pieces of data such as a boom moment around the boom proximal end portion and an arm moment around the boom proximal end portion are acquired in advance by actual measurement or the like at a plurality of attitudes at which the setting of the angle of the boom and the angle of the arm are changed, an attitude with high detection accuracy is selected from the plurality of pieces of acquired actual measurement data, and an angle of the boom and an angle of the arm corresponding to the selected attitude are stored in advance in the data storage section as the specific boom angle and the specific arm angle. As a result, it is possible to accurately specify the weight and the gravity center position of the distal end attachment at an attitude having high detection accuracy.

This application is based on Japanese Patent application No. 2021-083293 filed in Japan Patent Office on May 17, 2021, the contents of which are hereby incorporated by reference. Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A work machine comprising:

a machine body;

a boom having a boom proximal end portion which is a proximal end portion supported by the machine body so as to be raised and lowered;

an arm having an arm proximal end portion rotatably supported by a distal end portion of the boom and an arm distal end portion which is a distal end portion on an opposite side of the arm proximal end portion;

a distal end attachment having a distal end attachment proximal end portion which is a proximal end portion rotatably supported by the arm distal end portion;

a boom cylinder which is a hydraulic cylinder that operates so as to raise and lower the boom with respect to the machine body;

an arm cylinder which is a hydraulic cylinder that operates so as to rotate the arm with respect to the boom;

a distal end cylinder which is a hydraulic cylinder that operates so as to rotate the distal end attachment with respect to the arm;

an attitude detector that detects attitudes of the boom, the arm, and the distal end attachment;

a holding pressure detector that detects a holding pressure of the boom cylinder; and a controller including a property calculation section, wherein the property calculation section includes:

calculating a horizontal distance between the boom proximal end portion and the arm distal end portion based on a detection signal input from the attitude detector;

calculating a weight of the distal end attachment based on the horizontal distance and a detection signal input from the holding pressure detector in a state where the distal end attachment is disposed at a pressure release position which is a position when a pressure of the distal end cylinder is released; and calculating a gravity center position of the distal end attachment based on the weight of the distal end attachment, a detection signal input from the holding pressure detector, and a detection signal input from the attitude detector in a state where the distal end attachment is disposed at a displacement position which is a position different from the pressure release position.

2. The work machine according to claim 1, further comprising:

a start input reception part that receives an input for an operator to designate start of specifying processing which is processing for specifying the weight and the gravity center position of the distal end attachment, and outputs a command signal corresponding to the input to the controller, wherein the controller is configured to start the specifying processing when the command signal is input, and the controller further includes a guidance output section that outputs, to a display, such an image signal that makes an image related to guidance of the specifying processing be displayed on the display when the specifying processing is started.

3. The work machine according to claim 2, wherein when the command signal is input, the controller performs pressure release control for releasing the pressure of the distal end cylinder in the specifying processing.

4. The work machine according to claim 1, wherein the controller further includes a data storage section that stores a specific boom angle which is a preset angle of the boom and a specific arm angle which is a preset angle of the arm, and the property calculation section calculates the weight and the gravity center position of the distal end attachment in a state where the angle of the boom is adjusted to the specific boom angle and the angle of the arm is adjusted to the specific arm angle.

* * * * *